US005921848A

United States Patent [19]

Zang et al.

[11] Patent Number: 5,921,848

[45] Date of Patent: Jul. 13, 1999

[54] MULTI-DIRECTIONAL ABRADING MACHINE

[75] Inventors: Gregory Zang, Canton; Anthony C. Garf, Grosse Ile, both of Mich.

[73] Assignee: Flat Rock Metal, Inc., Flat Rock, Mich.

[21] Appl. No.: 08/869,633

[22] Filed: Jun. 5, 1997

Related U.S. Application Data

[63] Continuation of application No. 08/406,127, Mar. 17, 1995, abandoned.

[51] Int. Cl.[6] ..... B24B 9/00

[52] U.S. Cl. ..... 451/57; 451/63; 451/65; 451/184; 451/194; 451/336; 451/907

[58] Field of Search ..... 451/65, 66, 41, 451/53, 54, 57, 58, 63, 103, 109, 110, 111, 120, 121, 124, 184, 194, 195, 259, 260, 336, 901, 907

[56] References Cited

U.S. PATENT DOCUMENTS

| | | | |
|---|---|---|---|
| 2,715,796 | 8/1955 | Beard et al. | 451/65 |
| 2,759,301 | 8/1956 | Valette et al. | 451/65 |
| 3,869,373 | 3/1975 | Schacher et al. . | |
| 4,052,175 | 10/1977 | Lott et al. | 451/336 |
| 4,373,296 | 2/1983 | Kobayashi . | |
| 4,373,297 | 2/1983 | Pennertz et al. . | |
| 4,375,738 | 3/1983 | Bando | 451/65 |
| 4,461,124 | 7/1984 | Anderson | 451/336 |
| 4,498,821 | 2/1985 | Cazaux . | |
| 4,607,459 | 8/1986 | Rees | 451/450 |
| 4,760,671 | 8/1988 | Ward | 451/65 |
| 4,854,081 | 8/1989 | Pola et al. | 451/184 |
| 4,893,642 | 1/1990 | Parslow, Jr. et al. . | |
| 5,062,177 | 11/1991 | Huhmann . | |
| 5,103,663 | 4/1992 | Shafer et al. . | |
| 5,121,572 | 6/1992 | Hilscher . | |
| 5,271,135 | 12/1993 | Shifferly . | |

*Primary Examiner*—Eileen P. Morgan
*Attorney, Agent, or Firm*—Howard & Howard

[57] ABSTRACT

A multi-directional abrading machine for surface conditioning in the flat for elongated components, in particular, bumpers for motor vehicles. The machine comprises a frame including an upper portion and a lower portion. The upper and lower portions are adjustable with respect to each other. The machine includes both rotating abrading drums and rotating abrading discs. The machine preferably includes a pair of top abrading drums as well as one bottom abrading drum. The two top abrading drums are provided at the infeed side of the machine while the one bottom abrading drum is provided at the outfeed side of the machine. A coolant spray is strategically directed to the abrading drums. Between the pair of top abrading drums and the bottom abrading drum are mounted two abrading discs.

25 Claims, 4 Drawing Sheets

78
74
80
76
76'
10
32
60
68
66
68'
64
86
62
84
58
72
70
56
18
18'
34
34

10
32
146
148
214
212
28
28'
26
26'
24
24'
208
216
20
20'
22
22'
204
210
206
206
34
34

MULTI-DIRECTIONAL ABRADING MACHINE

This is a continuation of U.S. patent application Ser. No. 08/406,127, filed Mar. 17, 1995, now abandoned.

BACKGROUND OF THE INVENTION

1. Technical Field

The present invention is generally directed to the removal of burrs, micro slivers, and other surface imperfections from metals. More particularly, the present invention is directed to a multi-directional abrading machine having both abrading drums and abrading discs capable of removing burrs, micro slivers, and similar imperfections in a single, continuous process.

2. Discussion

Bright metal finishes have long been used in automobiles. The use of such finishes has been for both decorative as well as for rust-resistant reasons. Early automobiles incorporated polished brass radiators, hub caps, and other trim components. However, as automobile production increased, the use of brass was found to be too costly for mass production. In response, the automobile industry began to place a metal plating onto a metallic substrate, and many more components were plated. Typical components to be metal plated included radiator shells, door handles, light housings, hub caps, bumpers, and interior fixtures such as knobs and levers.

Early metal plating was nickel. While providing a satisfactory coating, nickel was relatively expensive and provided an inadequate luster. Ultimately, chromium electrodeposits used for decorative purposes were applied as thin coatings over underlying thicker nickel plate. Chromium plating provides considerable superiority over nickel and other plating in both providing a high luster and a high resistance to wear.

Present day chrome and nickel combinations are commonly plated over materials such as steel, brass and zinc-based die castings. Manufacturing of any of these metal composite results in a product that is inherently unsmooth and marred by burrs, micro slivers, and other surface imperfections. Prior to plating these components, the surfaces must be machined so as to remove all of these imperfections, and it is therefore critical that the surface be properly prepared for subsequent plating. Correct bonding between the metal substrate and the plating to be deposited on the substrate is critical, as incorrect adhesion will result in a product that is of poor quality. Specifically, if the substrate is not correctly and completely cleaned of imperfections, the plated material will be prone to peeling, blistering and cracking. While such undesirable qualities may be the result of other problems encountered during the preparation process, the smoothness of the surface plays a critical role in determining the ultimate quality of the final product.

Burrs, micro slivers, and other surface imperfections can often be found at the edges, corners, holes, slots, and other areas of the substrate. In many instances, these burrs, micro slivers, and other imperfections appear on the surface of the component. While burrs and micro slivers on corners, edges, holes and slots can be machined with relative ease by methods including abrasive wheels, discs and drums, the removal of burrs, micro slivers, and similar imperfections from substrate surfaces is typically an arduous and time consuming task.

To make the surface conditioning process simpler, various mechanical processes have been employed to remove the burr or micro sliver from the surface without damaging the adjacent substrate. Mechanical surface conditioning has conventionally been undertaken using grinding media composed virtually entirely of an abrasive grit, cloth, felt or leather, and comprising wheels and belts.

However, known systems for surface conditioning are time consuming and rely on expensive independent components. These systems are time consuming because they require multiple steps of deburring using separate tools, most of which are operated by hand. Furthermore, known systems are expensive because the separate tools are not directed to specific applications for specific components, but are rather tools that are applicable to general deburring. While providing broad-spectrum utility for many applications, known tools fail to provide effective surface conditioning to a specific component, such as an automobile bumper.

Machines to more readily perform the surface conditioning task have been developed. Some of these have specific uses. For example, in U.S. Pat. No. 5,121,572, issued on Jun. 16, 1992 to Hilscher for "Opposed Disc Deburring System," a deburring apparatus is provided having opposed double-disc, counter-rotating abrasive media retaining pads. The component to be deburred is carried through the pads on a turntable having workpiece receiving and guiding bores. As another example, in U.S. Pat. No. 4,373,297, issued on Feb. 15, 1993, to Pennertz et al. for "Deburring Machine", discloses a deburring machine having opposed brushes that drive against a workpiece fixed to a workpiece carriage. The motors may be adjusted to accommodate different lengths of work pieces.

Other inventions directed to the deburring of specific components provide improved levels of automation. For example, U.S. Pat. No. 4,893,642, issued on Jun. 16, 1990 to Parslow, Jr. et al. for "Production Line Part Deburring Apparatus", discloses a part deburring machine that is directed to the deburring of a part having established axes of rotation, such as engine crankshafts, camshafts, vehicle axles and the like. Another example of an automated machine directed to deburring specific components is disclosed in U.S. Pat. No. 5,103,663, issued Apr. 14, 1992 to Shafer et al. for "Dedimpler And Deburring Apparatus." In this patent, a combination dedimpler and deburring apparatus is provided for the dedimpling and deburring of tubes for use in the manufacture of children's toys and lawn furniture.

While representing improvements in the process of surface conditioning, none of the known general methods or specific applications disclosed in the known patents is desirable for the efficient and cost-effective surface conditioning of elongated, substantially planar workpieces such as bumpers.

SUMMARY OF THE INVENTION

It is therefore an object of the present invention to overcome the disadvantages of known surface conditioning equipment by providing a surface conditioning machine that effectively and efficiently deburs elongated, substantially planar objects such as bumpers for motor vehicles.

It is a further object of the present invention to provide such a machine that incorporates both abrasive discs and abrasive drums for surface conditioning a bumper.

A further object of the present invention is to provide such a system that utilizes a flow of water to assist in the surface conditioning process.

Yet another object of the present invention is to provide such a machine which provides minimal operator activity while providing maximum operator control.

Still another object of the invention is to provide such a machine that is easy to operate and simple to maintain.

Yet a further object of the present invention is to provide such a machine that includes an oscillating pair of abrading drums to maximize the effectiveness of the surface conditioning process.

The present invention achieves these objectives and others by providing a machine for surface conditioning prior to making elongated components, in particular, bumpers for motor vehicles. The machine of the present invention comprises a frame including an upper portion and a lower portion. The upper and lower portions are adjustable with respect to each other by manipulation of adjustable guide posts that maintain the upper portion in a spaced apart relationship from the lower portion. Each guide post is fitted with a worm gear screw jack for independent adjustment of each corner. The machine includes an infeed side and an outfeed side.

The machine of the present invention includes both rotating abrading drums and rotating abrading discs. Preferably, the machine includes a pair of top abrading drums as well as one bottom abrading drum. The two top abrading drums are provided at the infeed side of the machine while the one bottom abrading drum is provided at the outfeed side of the machine. A coolant spray may be strategically directed at the abrading drums. Between the pair of top abrading drums and the bottom abrading drum are mounted two abrading discs.

In order of operation, the workpiece to be conditioned is inserted into the infeed end of the machine where it is first surface conditioned by a first top abrading drum and then proceeds through the machine where it is then surface conditioned by a second top abrading drum, followed by a first abrading disc and then a second abrading disc. Finally, the piece being surface conditioned is worked by the bottom abrading drum, and thereafter exits the machine at the outfitted end. The provision of both abrading drums and discs provides multidirectional surface conditioning to the flat substrate. This procedure conditions all areas of the elongated part, that is, the flat portion of the bumper, as well as its sides, ends, and corners.

A plurality of motor-driven rollers are provided on the lower portion of the machine to form a conveyor. The workpiece is driven through the machine by the rotating action of the rollers. Both of the top abrading drums and the bottom abrading drum rotate in a direction opposite that of the rollers, this reverse rotation providing for efficient surface conditioning of the workpiece. The rollers opposing the top abrading drums are steel billy rolls while the roller opposing the bottom abrading drum is preferably a neoprene coated roll, as are the other rollers of the machine. Both of the two top abrading drums are capable of being oscillated, thereby assuring a thorough surface conditioning process. Each abrading disc as well as each of the abrading drums is provided with independent vertical adjustment to compensate for wear.

While the conveyor bed rollers are motor driven, pinch rollers are also provided strategically through the machine to feed parts past the abrading drums and discs.

To provide the operator with maximum control with a minimal amount of inconvenience, a stand-alone remote control panel is provided that includes necessary operator controls to effectively maneuver a workpiece through the machine. The panel includes a mechanical digital read-out that indicates the machine thickness setting, variable speed drive adjustment controls for each motor, coolant flow controls, load meters to show the exact amount of main motor horsepower being used during operation, and "ON" and "OFF" switches.

While the surface conditioning machine of the present invention finds particular application in the removal of micro slivers, it also has utility in deburring workpieces.

Other objects and advantages of the present invention will be made apparent as the description progresses.

BRIEF DESCRIPTION OF THE DRAWINGS

The present invention will be more fully understood by reference to the following detailed description of the preferred embodiment of the present invention when read in conjunction with accompanying drawings, in which like reference characters refer to like parts throughout the views, and in which.

DETAILED DESCRIPTION OF THE PREFERRED EMBODIMENT

Figure 1:
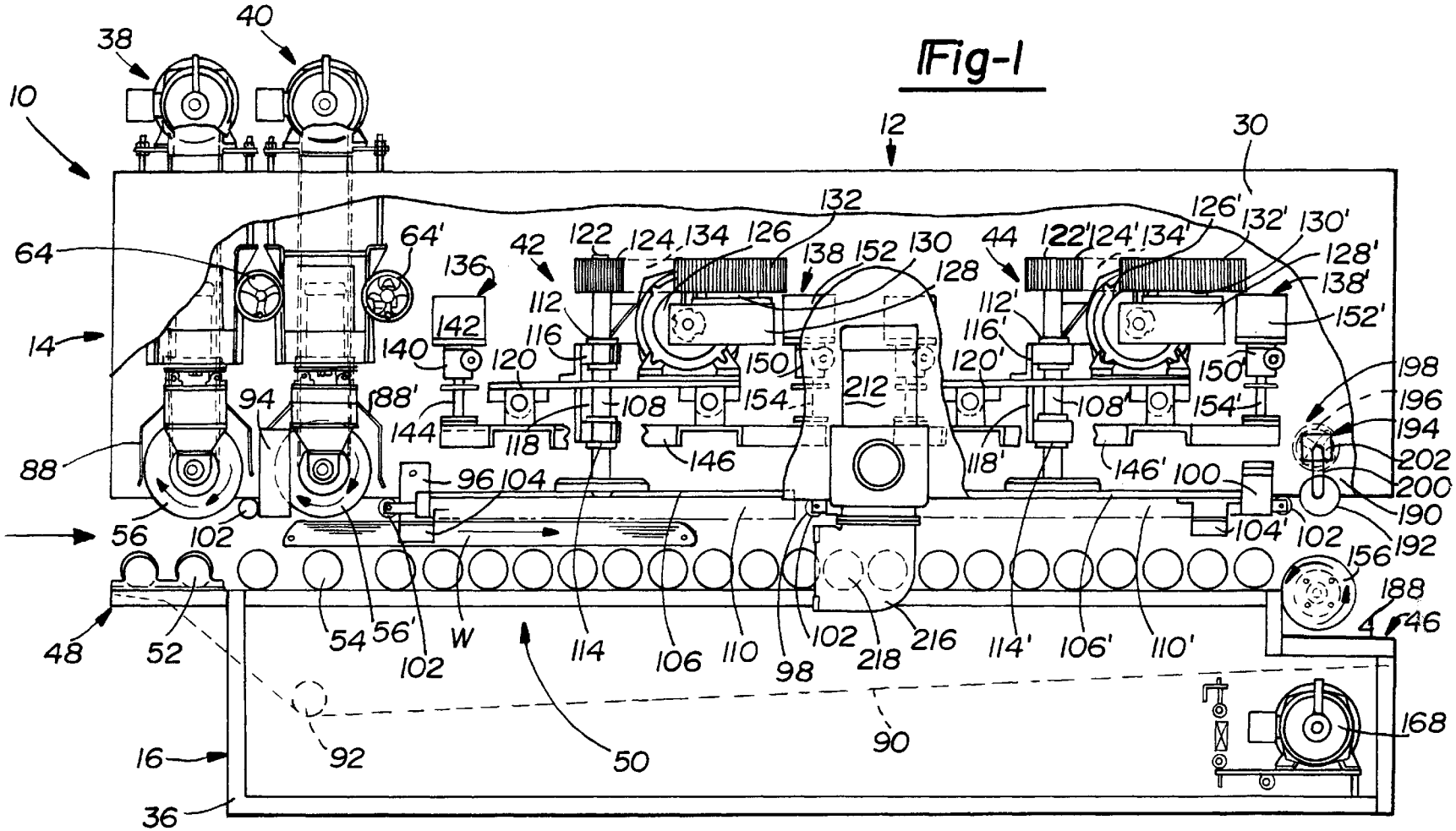
FIG. 1 is an elevational side view of the multi-directional surface conditioning machine of the present invention shown in partial cross section.

The drawings disclose the preferred embodiment of the present invention. While the configuration according to the illustrated embodiment is preferred, it is envisioned that alternative configurations of the present invention may be adapted without departing from the invention as portrayed. The preferred embodiment is discussed hereafter.

With reference to FIGS. 1 through 4, various views of a multi-directional surface conditioning machine, generally shown as 10, are illustrated. The machine 10 comprises a frame 12 that includes an upper portion 14 and a lower portion 16. The upper portion 14 is supported on four corner guide posts 18, 18' and 20, 20' that each include a screw jack assembly for individual adjustment. Each screw jack assembly includes a screw jack base 22, a vertical threaded shaft 24, a screw jack support 26 and an adjustment head assembly 28 that is operable in a known manner to raise or lower a respective corner so that the upper portion 14 can be adjusted to a desired height.

Figure 2:
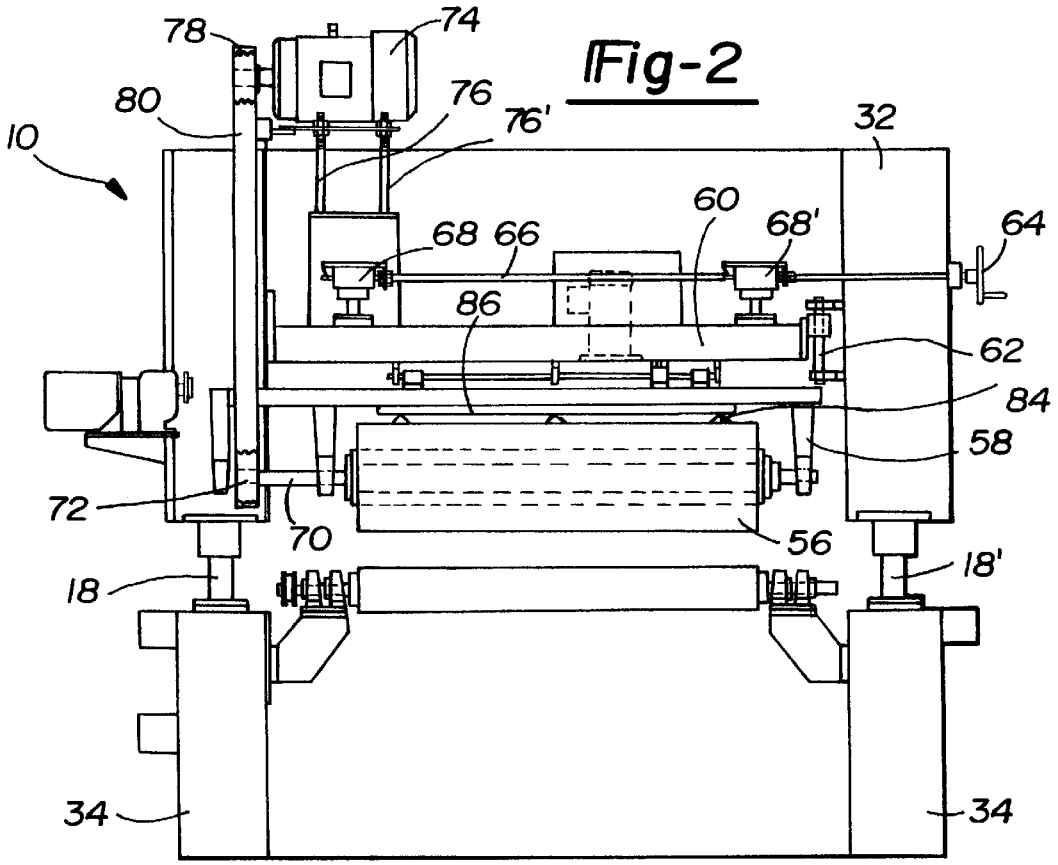
FIG. 2 is an end view partially in cross section of the machine of FIG. 1 and illustrates the workpiece infeed side.
Figure 3:
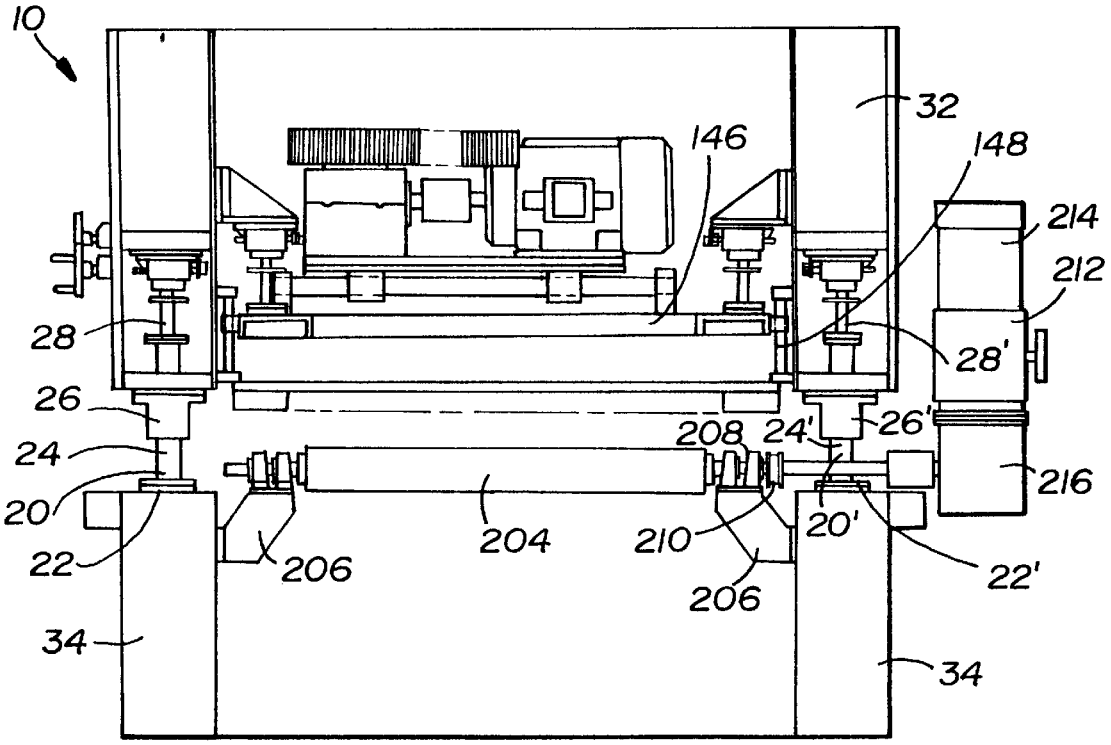
FIG. 3 is an end view partially in cross section of the machine of FIG. 1 and illustrates the workpiece outfeed side.

The upper portion 14 includes an external housing, partially shown as 30 in FIG. 1, and a frame, partially visible as 32 in FIGS. 2 and 3. Both the screw jack support 26 and the head assembly 28 of each screw jack assembly are mounted on the frame 32. The housing 30 includes a number of access doors (not shown) to allow for machine maintenance and to change abrading material on the abrading drums and discs as necessary.

Similarly, the lower portion 16 includes an external housing, partially visible as 34 in FIGS. 2 and 3, and a frame, partially visible as 36 in FIG. 1. The screw jack base 22 is supported on the frame 36. Both the frames 32 and 36 are composed of a combination of steel weld elements and cast iron. This combination is useful in that it substantially eliminates vibration. As with the housing 30 for the upper portion 14, the housing 34 incudes a number of access doors (not shown) primarily to allow for the changing of the rolls described below.

The surface conditioning machine 10 includes both media-coated rotating abrading drums and rotating abrading discs. More particularly, the machine 10 includes a first top drum assembly, generally illustrated as 38, a second top drum assembly, generally illustrated as 40, a first disc assembly, generally illustrated as 42, and a second disc assembly, generally illustrated as 44. In addition, the machine 10 includes a bottom drum assembly, generally illustrated as 46, and best shown in FIG. 4.

Opposing the assemblies 38, 40, 42, and 44 is a conveyor bed assembly 48. The conveyor bed assembly 48 comprises a plurality of driven rollers, generally illustrated as 50, that include a first steel billy roller 52 that opposes the first drum assembly 38 and a second steel billy roller 54 that opposes the second drum assembly 40. The remainder of the driven rollers 50 are polymer coated rollers, with the preferred polymer being neoprene. All of the rollers 50, including the steel billy rollers 52 and 54, are of the same diameters.

The first top drum assembly 38 and the second top drum assembly 40 comprise the "infeed drums" and are substantially identical. Accordingly, and to avoid unnecessary confusion, generally just one of any two like components of the assemblies 38 and 40 will be discussed, although both the discussed component as well as its counterpart are shown in the several figures, with the latter being identified by its being primed. It is to be understood that discussion of the one will apply to the primed component not discussed.

The top drum assembly 38 includes a cylindrical abrading drum 56 of the "Brushlon" type (trademark; 3-M Company) and preferably having a diameter of about 12". The drum 56 is composed of synthetic fibers embedded in a resinous backing material. The drum 56 is supported by a drum arbor 58. The arbor 58 is mated to an arbor adjustment assembly 60 that is attached to the frame 32 by a vertically-adjustable rack assembly 62. The rack assembly provides for vertical movement of the assembly 60. The assembly 60 includes an adjustment wheel 64 fixed to a shaft 66 that is rotatably mated with a pair of elevators 68 and 68'. Rotation of the wheel 64 in one direction or the other results in the vertical movement of the drum 56. This provision for vertical adjustment of the drum 56 allows the operator to move the drum 56 so as to compensate for its being worn after repeated surface conditioning procedures. The assembly 60 also allows the operator to adjust the width of the infeed opening (preferably to a maximum opening of about 3").

The drum 56 includes a driven end 70 having a pulley 72. A driving motor 74 is fixed to the arbor adjustment assembly 60 through a pair of supports 76 and 76'. The driving motor 74 is of the 10HP, TEFC type. The driving motor 74 includes a pulley 78. A belt 80 connects the pulley 72 of the drum 56 and the pulley 78 of the motor 74.

The drum 56 incorporates an oscillating support 82 that allows the drum 56 to oscillate with respect to the arbor 58. The drum 56 preferably oscillates about ¼" stroke at 175 CPM. The oscillating movement of the drum 56 provides a thorough, "wrap-around" surface conditioning of the corners and sides of bumpers.

The process of surface conditioning inherently produces undesirable quantities of dust. In addition, the abrading drum 56 produces a considerable amount of heat energy on contact with the workpiece, and this energy results in premature deterioration of the synthetic fibers that comprise the drum 56. Accordingly, it is preferred that the surface conditioning operation be undertaken in a wet environment. For this purpose, a plurality of fluid nozzles 84 are fitted to a fluid line 86. A fluid reservoir (not shown) provides a source of fluid for the line 86. A fluid of the water soluble, rust inhibiting, coolant-type is directed through the fluid line 86, out of the nozzles 84, and at the drum 56. A shield 88 limits overspray. Motor and roller bearings (not shown) are selected from the types that are fluid-resistant. The preferred fluid flow is about 75 GPM. A coolant collector pan 90 is provided in the lower portion 16 and includes a recapture port 92. After spraying, coolant is gathered in the pan 90 and enters the port 92 for recycling through the machine 10 for reuse.

In addition to assisting in cooling of the abrading drums, the fluid allows the operator to rinse the swarf out of the machine 10 prior to and during a surface conditioning operation. In addition, the flowing fluid results in conditioned workpieces having better and more consistent finishes than if the conditioning operation was run dry. Furthermore, the flowing fluid prolongs abrasive life and eliminates air-borne dust particles.

As illustrated by the arrows, the direction of rotation of the drum 56 is in a direction opposite that of the infed workpiece, generally illustrated as "W" in FIG. 1. This contrary motion is necessary to produce the desired abrading effect. Accordingly, to assist the operator in the "upstream" movement of the workpiece "W", a series of pinch roller assemblies are strategically positioned within the machine 10 along the path of the workpiece. The assemblies, identified as 94, 96, 98, and 100, control feed of the workpiece through the machine 10. The through-speed of the workpiece "W" is controlled by the assemblies 94, 96, 98, and 100 and is variable between 30 and 75 feet per minute. The assemblies 94, 96, 98, and 100 each include a pinch roller 102 that, together with its corresponding one of the adjacent rollers 50, is serrated to assure a complete grip of the workpiece "W".

To assist in the proper passage of the workpiece "W", two sets of vertical guide wheels 104 and 104' are rotatably attached to the frame 32. The set of guide wheels 104 is located adjacent the outfeed side of the assembly 40, while the set of guide wheels 104' is located adjacent the outfeed side of the assembly 44.

As with the assemblies 38 and 40, the assemblies 42 and 44 are essentially identical to each other. Accordingly, generally just one of any two like components of the assemblies 42 and 44 will be discussed, although the discussed component as well as its counterpart are shown in the several figures, with the latter being identified by its being primed.

The assembly 42 includes a rotating abrading disc 106 attached to a rotary disc arbor 108. The disc 106 is preferably about 48" in diameter and functions to rotate in a horizontal plane over adjacent ones of the conveyor bed rollers 50. A surface conditioning media 110 is releasably attached to the disc 106. Releasable attachment is provided for by release fasteners such as hook-and-loop fasteners (not shown) where, for example, the hook portion is fitted to the underside of the disc 106 while the loop portion is fitted to the top side of the surface conditioning media 110. The media 110 may be composed of either non-woven nylon media pads or nylon-impregnated bristle brushes. In either event, the material for the media 110 is selected for its abrading and cleaning characteristics so that both steps may be accomplished during the present process.

The arbor 108 is rotatably supported in a pair of coaxial bearings 112 and 114. A pair of bearing support brackets 116 and 118 extend from a horizontal support platform 120.

The arbor 108 includes a driving end 122 to which is fixed a toothed pulley 124. An electric motor 126 is horizontally mounted on and fastened to the platform 120. The motor 126 is preferably of the 10HP, TEFC type. The driving end of the motor 126 is mated to a transmission 128 that incorporates gearing (not shown) which translates rotary horizontal motion to rotary vertical motion. The transmission 128 includes and output shaft 130 to which is fixed a toothed driving pulley 132. Rotational movement of the driving pulley 132 is transmitted to the same direction at the same speed as the pulley 124 by a belt 134 (shown in broken lines).

The assembly 42 is vertically adjustable to compensate for wear of the disk 106. Vertical adjustment of the assembly 42 is provided by two vertical adjacent assemblies 136 and 138.

The assembly 136 includes a worm gear screw jack 140 fixed to a bracket 142. The bracket 142 is attached to the frame 32. Extending from the jack 140 is a vertically movable shaft 144. The shaft 144 is fixed to a supporting table 146. Also fixed to the table 146 is the platform 120. The table 146 is vertically adjustable on a vertical adjustment rack 148 attached to the frame 32.

The assembly 138 includes a worm gear screw jack 150 fixed to a bracket 152. The bracket 152 is attached to the frame 32. A vertically movable shaft 154 is fixed to the supporting table 146.

In addition to being vertically movable to compensate for media wear, the assemblies 42 and 44 are horizontally movable perpendicularly from the centerline along the long axis of the rollers 50 toward either side of the machine 10. This adjustment may be made for approximately between 6" and 12" to either side of the centerline by a handreel and an appropriate mechanism (not shown).

Figure 4:
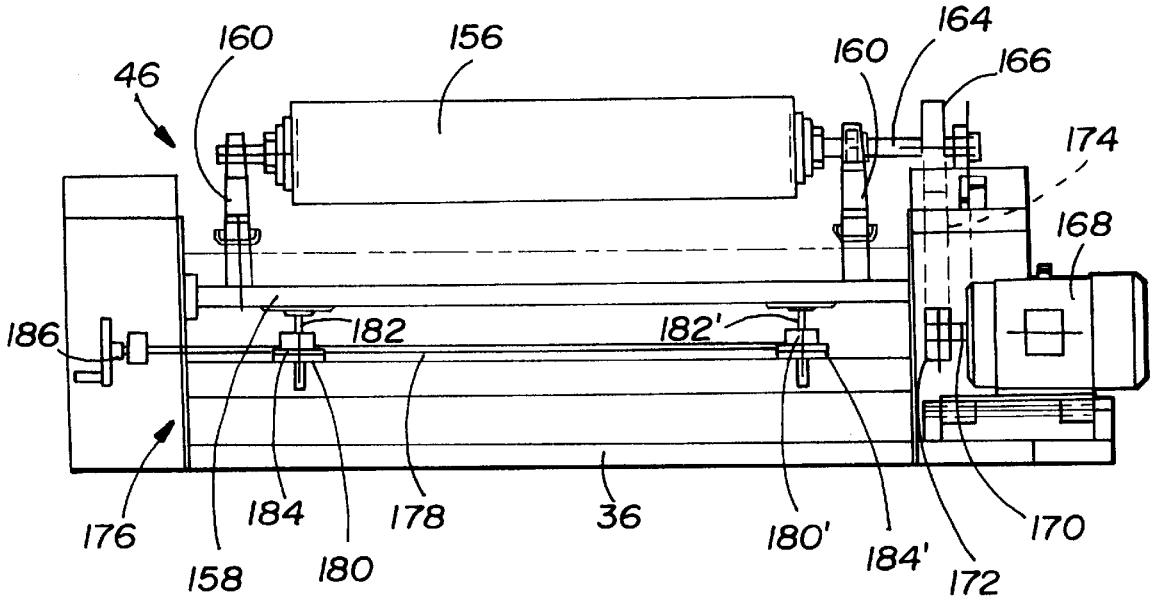
FIG. 4 is an end view of a bottom abrading drum and motor assembly that is cut away from the end view of FIG. 3.
Figure 5:
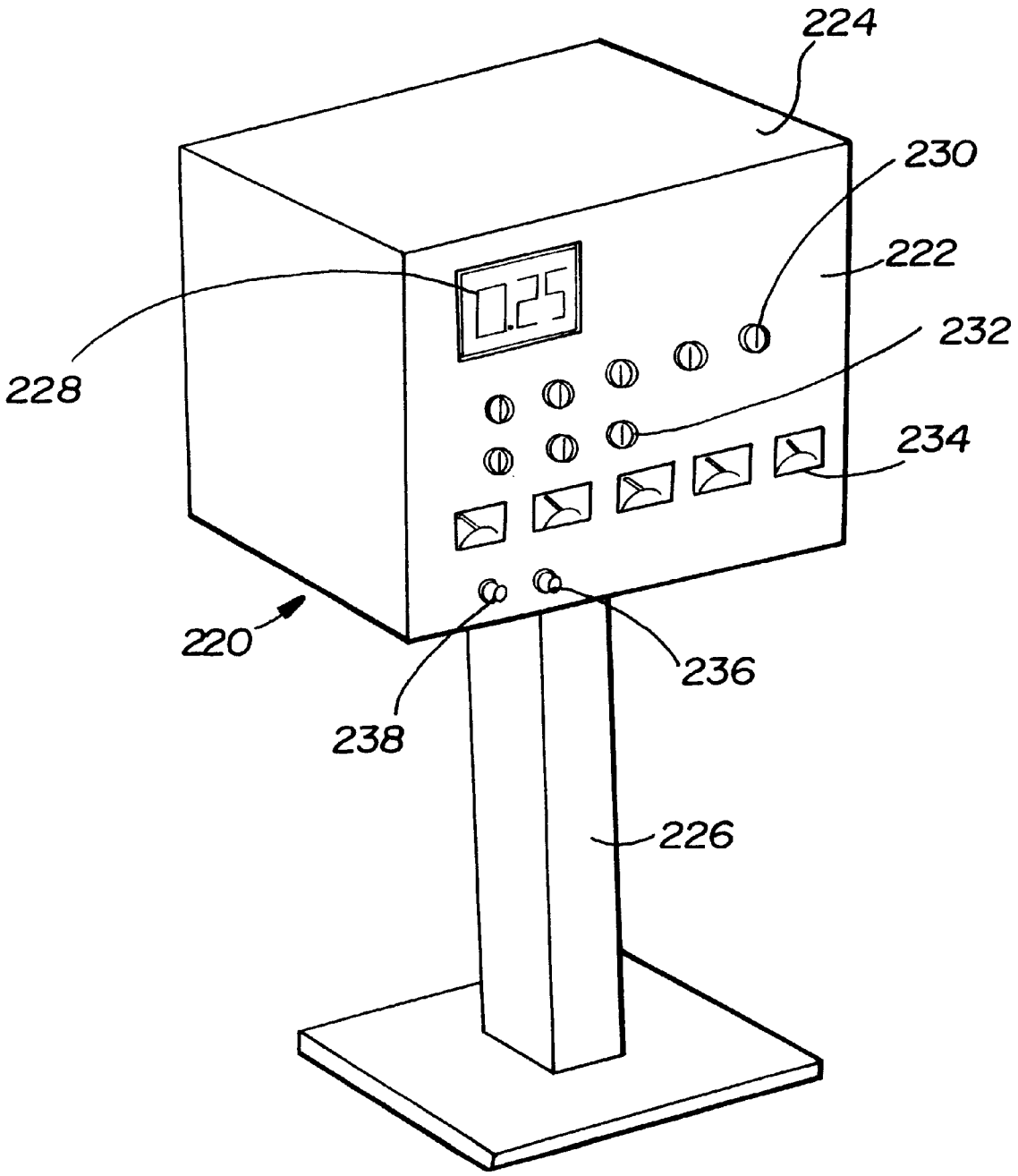
FIG. 5 is a perspective view of the remote, stand-alone operating panel for controlling the machine of FIGS. 1 through 4.

The bottom roller assembly 46, shown in FIG. 1 and best shown in FIG. 4 in its broken-away view, includes an outfeed drum 156 that is supported on a vertically movable frame 158. The drum 156 preferably has a diameter of about 9". A pair of horizontal support brackets 160 and 162 support the drum 156 on the frame 158. The drum 156 includes a driven end 164 having a driven pulley 166.

A drive motor 168 is attached to the frame 158. The motor 168 is preferably of the 10HP, TEFC type. The drive motor 168 includes an output end 170. Attached to the output end 170 is a drive pulley 172. A drive belt 174 connects the pulleys 166 and 172.

Like the assemblies 42 and 44, the assembly 46 is vertically adjustable to allow compensation for wear. A vertical adjustment assembly, generally illustrated as 176, provides a system for the vertical adjustment of the assembly 46. The assembly 176 includes an adjusting rod 178 and a pair of screw assemblies 180 and 180' each include vertically adjustable arms 182 and 182', respectively, which are attached at their top sides to the frame 158. The screw assemblies 180 and 180' each further include bases 184 and 184', respectively. The bases 184 and 184' are fixed to the frame 36.

The adjusting rod 178 is rotatably positioned through the bases 184 and 184' and is operably engaged with the adjustable arms 182 and 182'. At one end of the rod 178 is attached a crank 186. Rotational motion of the crank 186 is translated into vertical motion of the arms 182 and 182', thereby effecting selective raising and lowering of the assembly 46 as necessary to compensate for wear of the drum 156. As with the assemblies 38 and 40, a fluid nozzle 188 is provided for delivering coolant to the drum 156.

Above the drum 156 and in axial alignment with the drum 156 is an outfeed billy roller assembly 190. The assembly 190 includes an outfeed billy roller 192 and a vertical adjustment assembly 194. The billy roller 192 is urethane covered to improve wear resistance. The vertical adjustment assembly 194 is similar to the assembly 176 and includes a crank 196 that is attached, via a rod (not shown) to a screw assembly 198. The screw assembly 198 includes a pair of vertically movably shafts 200 adapted for vertical movement in a housing 202 (only one shaft 200 and one housing 202 are illustrated). The housing 202 is fixed to the frame 32. Rotation of the crank 196 acts on the shaft 200 (and its unseen twin) to effect selected vertical motion of the roller 192.

As noted previously, the conveyor bed assembly 48 comprises a plurality of driven rollers, collectively identified as 50. One of these rollers, roller 204, is shown in FIG. 3 and is exemplary. The roller 204 is rotatably mounted on the frame 32 by a pair of supports 206 and 206'. The roller 204 includes a driven end 208 having a driven sprocket 210.

A drive motor assembly 212 is mounted on the far side of the machine 10 and is fixed to the frame 32. The motor assembly 212 includes a vertically mounted motor 214 and is operatively attached to a gearbox 216. The gearbox 216 includes bevel gears (not shown) which translate vertical rotational movement into horizontal rotational movement for driving a driven roller 218. The driven roller 218 includes a driving sprocket (not shown) that drives a continuous chain, preferably a #40 or a #50 chain (also not shown). The continuous chain is operatively mated to the driven sprockets 210 fixed to the end of the rollers 50.

Operation of the machine 10 is possible from a remote, stand-alone console, generally illustrated as 220. Because the console 220 is remotely situated, the machine 10 may be virtually entirely operated from a position of relative safety.

The remote console 220 includes an instrument panel 222, a protective housing 224, and a stand 226. The panel 224 includes a mechanical digital read-out 228 that indicates the workpiece thickness setting of the machine 10. Also situated on the panel 224 is a motor speed control array 230 that includes five variable speed control knobs, one each to control the motors of the assemblies 38, 40, 42, 44 and 46. A coolant control panel 232 allows the operator to control coolant flow through each of the three coolant nozzles.

A load meter array 234 is fitted to the panel 224 and includes an array of five load meters, one each for each motor. The load meters of the array 234 provide the operator with information as to the exact amount (as a percentage of the total) of horsepower being consumed by the motor assembly 212 driving the rollers 50. This information is valuable to the operator by ensuring that machine changeover time from component to component is held to a minimum. Power consumption information is also useful in preventing possible motor brown-out or burn-out.

The panel 222 also supports an "ON" button 236 and an "OFF" button 238.

The machine 10 preferably includes across-the-line magnetic type starters (not shown) which include heater-type overload protection. These starters are located in NEMA 12 dust-tight electrical enclosures that contain starters, relays and 110 voltage control circuits.

Operation of the machine 10 includes the steps of activating the "ON" button 236, positioning the workpiece "W" into the infeed end, and observing the load meter 234. The controls of the motor control array 230 are adjusted as needed. Cooling fluid flow is also controlled during the operation. The conditioned workpiece (preferably having a maximum width of about 40") exits the outfeed end of the machine 10 after the surface conditioning operation is completed.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A multidirectional surface conditioning machine for surface conditioning a workpiece, the workpiece having an upper surface, a lower surface, and a width, said machine comprising:

a supporting frame having an infeed side and an outfeed side;

a horizontally-positioned roller-type conveyor for conveying a workpiece from said infeed side of said supporting frame to said outfeed side, said horizontally-positioned conveyor being mounted in association with said supporting frame;

a rotatable upper surface conditioning drum having a relatively rigid exterior with an abrading surface supported on said exterior for conditioning the upper surface of the workpiece, said upper surface conditioning drum being rotatably mounted in association with said supporting frame;

a rotatable surface conditioning disc, said surface conditioning disc having a substantially flat abrading surface with a diameter that is greater than the width of the workpiece, said surface conditioning disc being mounted in association with said supporting frame; and a rotatable surface conditioning drum for conditioning the lower surface of the workpiece, said lower surface conditioning drum being rotatably mounted in association with said supporting frame, said lower surface conditioning drum being vertically adjustable relative to said roller-type conveyor.

2. The multidirectional surface conditioning machine of claim 1, wherein said conveyor is substantially horizontal with respect to said frame.

3. The multidirectional surface conditioning machine of claim 2, wherein said rotatable upper surface conditioning drum has a rotatable axis, and wherein said axis of said rotatable upper surface conditioning drum is substantially horizontal with respect to said frame.

4. The multidirectional surface conditioning machine of claim 3, wherein said rotatable surface conditioning disc has a rotational axis, said rotational axis of said rotatable surface conditioning disc being substantially vertical with respect to said frame.

5. The multidirectional surface conditioning machine of claim 1, wherein said frame includes an upper portion and a lower portion.

6. The multidirectional surface conditioning machine of claim 5, wherein said upper and lower portions being adjustable with respect to one another.

7. The multidirectional surface conditioning machine of claim 5, wherein said rotatable surface conditioning drum is provided in said upper portion of said frame adjacent said infeed side of said frame.

8. The multidirectional surface conditioning machine of claim 5, wherein said rotatable surface conditioning disc is provided in said upper portion of said frame.

9. The multidirectional surface conditioning machine of claim 1, wherein said rotatable surface conditioning drum oscillates.

10. The multidirectional surface conditioning machine of claim 7, wherein said rotatable surface conditioning drum is a first rotatable surface conditioning drum, said machine further including a second rotatable surface conditioning drum, said second rotatable surface conditioning drum being positioned adjacent said first rotatable surface conditioning drum.

11. The multidirectional surface conditioning machine of claim 10, wherein said rotatable surface conditioning disc is a first rotatable surface conditioning disc, said first rotatable surface conditioning disc being positioned adjacent said second rotatable surface conditioning drum, said machine further including a second rotatable surface conditioning disc, said second rotatable surface conditioning disc being positioned adjacent said first rotatable surface conditioning disc.

12. The multidirectional surface conditioning machine of claim 11, wherein said machine further includes a third rotatable surface conditioning drum.

13. The multidirectional surface conditioning machine of claim 12, wherein said third rotatable surface conditioning drum is positioned between said second rotatable surface conditioning disc and said outfeed side of said frame.

14. The multidirectional surface conditioning machine of claim 13, said machine further including a cooling system that uses liquid for cooling selected ones of said rotatable drums.

15. The multidirectional surface conditioning machine of claim 14, wherein said conveyor comprises a plurality of driven rollers.

16. A multidirectional surface conditioning machine for surface conditioning a workpiece having a top side and a bottom side, said machine comprising:

a supporting frame;

means operating in a first direction relative to said supporting frame for surface conditioning the top side of the workpiece, said means operating in a first direction for surface conditioning being associated with said supporting frame;

means operating in a second direction relative to said supporting frame for surface conditioning the top side of the workpiece, said means operating in a second direction for surface conditioning being associated with said supporting frame, said second direction being substantially perpendicular to said first direction;

means for surface conditioning the bottom side of the workpiece, said means for surface conditioning the bottom side of the workpiece being operatively associated with said supporting frame; and means for cooling operatively associated with said supporting frame, said means for cooling comprising a coolant sprayer that sprays a liquid coolant onto said means for operating in a first direction.

17. The multidirectional surface conditioning machine of claim 16, further including means operating in a third direction relative to said supporting frame for surface conditioning the workpiece, said means operating in a third direction for surface conditioning being associated with said supporting frame, said third direction being substantially opposite said second direction.

18. The multidirectional surface conditioning machine of claim 17, wherein said means operating in a second direction for surface conditioning a workpiece and said means operating in a third direction for surface conditioning a workpiece compose a surface conditioning disc having a substantially planar rotating abrading surface.

19. The multidirectional surface conditioning machine of claim 16, wherein said means operating in a first direction for surface conditioning a workpiece comprises a surface conditioning roller having a rigid drum-shaped abrading surface.

20. The multidirectional surface conditioning machine of claim 19, wherein said frame includes an infeed side and an outfeed side, said machine further including a conveyor for conveying said workpiece from said infeed side to said outfeed side.

21. A method for surface conditioning the top side and the bottom side of a workpiece, said method including the steps of:

introducing a workpiece into a surface conditioning machine having a long axis and having an infeed side and an outfeed side and having at least two rotating abrading drums and at least two rotating abrading discs therebetween;

conveying said workpiece from said infeed side by a first one of said rotating abrading drums to condition the top side of said workpiece;

spraying a liquid coolant onto said first one of said rotating drums;

conveying said workpiece along the long axis of the surface conditioning machine from said first one of said rotating abrading drums to a first one of said rotating abrading discs;

conveying said workpiece by said first one of said rotating abrading discs;

conveying said workpiece along said long axis of the surface conditioning machine to a second one of said rotating abrading discs, said first and second abrading discs being aligned colinearly along said long axis of the surface conditioning machine;

conveying said workpiece by said second one of said rotating abrading discs;

conveying said workpiece by a second one of said rotating drums to condition the bottom side of said workpiece;

conveying said workpiece from said second one of said rotating drums to said outfeed side; and removing said workpiece from said surface conditioning machine.

22. The method for surface conditioning a workpiece of claim 21, said method including the further step of conveying said workpiece by a second rotating abrading drum subsequent to said step of conveying said workpiece by said at least one rotating abrading drum.

23. The method for surface conditioning a workpiece of claim 22, said method including the further step of conveying said workpiece by a second rotating abrading disc subsequent to said step of conveying said workpiece by said at least one rotating abrading disc.

24. The method for surface conditioning a workpiece of claim 23, said method including the further step of conveying said workpiece by a third rotating drum prior to the step of conveying said workpiece to said outfeed side.

25. The method of claim 21, wherein the rotating abrading drums have a rigid outer diameter supporting an abrading surface.

* * * * *